US007237460B2

(12) United States Patent
Hu

(10) Patent No.: US 7,237,460 B2
(45) **Date of Patent: *Jul. 3, 2007**

(54) BIASING ARRANGEMENT FOR A PAWL OF A REVERSIBLE RATCHET-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/942,061

(22) Filed: Aug. 29, 2001

(65) Prior Publication Data

US 2002/0023520 A1 Feb. 28, 2002

Related U.S. Application Data

(63) Continuation of application No. 09/541,193, filed on Apr. 3, 2000, now Pat. No. 6,282,992.

(30) Foreign Application Priority Data

Feb. 3, 2000 (TW) ..... 89202280 U

(51) Int. Cl.
*B25B 13/46* (2006.01)

(52) U.S. Cl. ..... 81/63.2; 81/60; 192/43.2

(58) Field of Classification Search ..... 81/60–63.2, 81/58.4; 192/43.1, 43.2; *B25B 13/46*
See application file for complete search history.

(56) References Cited

U.S. PATENT DOCUMENTS 15,482 A 8/1856 Gilman ..... 81/63
726,012 A 4/1903 Andrew
810,599 A 1/1906 Ansorge
818,761 A 4/1906 Hanes et al.

(Continued)

FOREIGN PATENT DOCUMENTS

DE 373436 4/1923

(Continued)

OTHER PUBLICATIONS

EPO Search Report for Appln. No. EP 00 12 6902 dated Feb. 17, 2003 (3p.) 0570.

(Continued)

*Primary Examiner*—Hadi Shakeri
(74) *Attorney, Agent, or Firm*—Conley Rose, P.C.

(57) ABSTRACT

A reversible ratchet-type wrench includes a handle and a head extended from the handle and having a hole. A web is defined between the handle and the head, and a cavity is defined in the web and communicated with the hole. The web further includes a compartment having a first end communicated with the cavity and a second end communicated with outside, thereby leaving a bridge in the web. A drive member is rotatably mounted in the hole of the head. A pawl is mounted in the cavity and includes a first side with ratchet teeth for releasably engaging with teeth on an outer periphery of the drive member. A switch member includes a turn-piece for manual operation and an actuating plate extended from the turn-piece and rotatably received in the second end of the compartment of the head. The switch member is switchable between two positions for changing ratcheting direction of the drive member. A biasing arrangement is mounted in the cavity and between the pawl and the actuating plate for biasing the ratchet teeth of the pawl to engage with the teeth of the drive member.

21 Claims, 11 Drawing Sheets

U.S. PATENT DOCUMENTS

| | | | | |
|---|---|---|---|---|
| 841,686 | A | 1/1907 | Hatfield | |
| 878,657 | A | 2/1908 | Munch | |
| 893,097 | A | 7/1908 | Reams | |
| 915,446 | A | 3/1909 | Kearnes | |
| 1,033,358 | A | 7/1912 | Turner | |
| 1,090,578 | A | 3/1914 | Smythe | |
| 1,194,471 | A | 8/1916 | Boosinger | |
| 1,261,092 | A | 4/1918 | Allen | |
| 1,382,492 | A | 6/1921 | Evans | 81/63 |
| 1,426,127 | A | 8/1922 | Tuttle | |
| 1,601,767 | A | 10/1926 | Peterson | |
| 1,614,039 | A | 1/1927 | Mandl | |
| 1,639,078 | A | 8/1927 | Coe | |
| 1,680,515 | A | 8/1928 | Gormley | |
| 1,772,524 | A | 8/1930 | Seidemann | |
| 1,957,462 | A | 5/1934 | Kress | 81/63 |
| 2,193,984 | A | 3/1940 | Rhinevault | |
| 2,201,705 | A | 5/1940 | Stone | |
| 2,201,827 | A | 5/1940 | Froeschl et al. | |
| 2,317,461 | A | 4/1943 | Jackson | |
| 2,542,241 | A | 2/1951 | Fors | |
| 2,612,807 | A | 10/1952 | Hunt | |
| 2,657,604 | A | 11/1953 | Rues | 81/63.2 |
| 2,701,977 | A | 2/1955 | Stone | |
| 2,764,048 | A | 9/1956 | Thompson | |
| 2,769,360 | A | 11/1956 | Cottrell et al. | |
| 2,800,821 | A | 7/1957 | Fruscella | |
| 2,803,980 | A | 8/1957 | Vogel | |
| 2,891,434 | A | 6/1959 | Lozensky | |
| 2,957,377 | A | 10/1960 | Hare | |
| 2,978,081 | A | 4/1961 | Lundin | |
| 3,019,682 | A | 2/1962 | Hare | 81/63.2 |
| 3,044,591 | A | 7/1962 | Kilness | |
| 3,233,481 | A | 2/1966 | Bacon | |
| 3,250,157 | A | 5/1966 | Badger | |
| 3,265,171 | A | 8/1966 | Kilness | 81/63 |
| 3,269,496 | A | 8/1966 | Kilness | |
| 3,337,014 | A | 8/1967 | Sandrick | 81/63 |
| 3,342,229 | A | 9/1967 | Janes | |
| 3,393,587 | A | 7/1968 | Jolliff et al. | |
| 3,393,780 | A | 7/1968 | Kilness | 81/63 |
| 3,436,992 | A | 4/1969 | Over et al. | |
| 3,490,317 | A * | 1/1970 | Rozmus | 81/62 |
| 3,508,455 | A | 4/1970 | Miller | |
| 3,575,069 | A | 4/1971 | White | |
| 3,577,816 | A | 5/1971 | Alexander et al. | |
| 3,598,001 | A | 8/1971 | Thomasian | |
| 3,606,940 | A | 9/1971 | Finkeldei | |
| 3,691,876 | A | 9/1972 | Cassidy, Jr. | |
| 3,713,356 | A | 1/1973 | Knudsen | |
| 3,742,788 | A | 7/1973 | Priest | |
| 3,783,703 | A | 1/1974 | Trimble et al. | |
| 3,838,614 | A | 10/1974 | O'Donnell | |
| 3,866,492 | A | 2/1975 | Knoll | |
| 3,908,487 | A | 9/1975 | Plaw | |
| 3,970,155 | A | 7/1976 | Otto | |
| 4,053,037 | A | 10/1977 | Solomon | |
| 4,070,932 | A | 1/1978 | Jeannotte | |
| 4,111,077 | A | 9/1978 | Cummings et al. | |
| 4,128,025 | A | 12/1978 | Main et al. | 81/63 |
| 4,147,076 | A | 4/1979 | Wright et al. | |
| 4,257,507 | A | 3/1981 | Solomon | |
| 4,274,311 | A | 6/1981 | Ebert | |
| 4,277,989 | A | 7/1981 | Tracy | |
| 4,277,990 | A | 7/1981 | Hall | |
| 4,308,768 | A | 1/1982 | Wagner | |
| 4,308,769 | A | 1/1982 | Rantanen | |
| 4,328,720 | A | 5/1982 | Shiel | |
| 4,336,728 | A * | 6/1982 | Deibert | 81/62 |
| 4,406,186 | A | 9/1983 | Gummow | |
| 4,420,995 | A | 12/1983 | Roberts | |
| 4,485,700 | A | 12/1984 | Colvin | |
| 4,488,460 | A | 12/1984 | Ballone et al. | |
| 4,512,218 | A | 4/1985 | Chow | |
| 4,520,697 | A | 6/1985 | Moetteli | |
| 4,631,988 | A | 12/1986 | Colvin | |
| 4,662,251 | A | 5/1987 | Kohal | |
| 4,709,600 | A | 12/1987 | Mierbach et al. | |
| 4,722,252 | A | 2/1988 | Fulcher et al. | |
| 4,722,253 | A | 2/1988 | Chow | |
| 4,762,033 | A | 8/1988 | Chow | |
| 4,770,072 | A | 9/1988 | Neuhaus | 81/63.2 |
| 4,777,852 | A | 10/1988 | Herman et al. | |
| 4,796,492 | A | 1/1989 | Liou | 81/58.4 |
| 4,807,500 | A | 2/1989 | Main | |
| 4,862,775 | A | 9/1989 | Chow | |
| 4,869,138 | A | 9/1989 | Farris | |
| 4,903,554 | A | 2/1990 | Colvin | |
| 4,924,737 | A | 5/1990 | Gummow | |
| 4,934,220 | A | 6/1990 | Slusar et al. | |
| 4,986,147 | A | 1/1991 | Cooper | |
| 4,991,468 | A | 2/1991 | Lee | |
| 5,000,066 | A | 3/1991 | Gentiluomo | |
| 5,012,705 | A | 5/1991 | Chow | |
| 5,038,452 | A | 8/1991 | Beugelsdyk et al. | |
| 5,076,121 | A | 12/1991 | Fosella | 81/58.4 |
| 5,095,781 | A | 3/1992 | Blake | |
| 5,144,869 | A | 9/1992 | Chow | |
| 5,157,994 | A | 10/1992 | Krivec | 81/63.2 |
| 5,178,047 | A | 1/1993 | Arnold et al. | 81/63.2 |
| 5,199,330 | A | 4/1993 | Arnold et al. | |
| 5,199,335 | A | 4/1993 | Arnold et al. | |
| 5,230,262 | A | 7/1993 | Ahlund et al. | 81/63.2 |
| 5,231,903 | A | 8/1993 | Bockman, Jr. | |
| 5,233,891 | A | 8/1993 | Arnold et al. | 81/63.2 |
| 5,271,300 | A | 12/1993 | Zurbuchen et al. | |
| 5,295,422 | A | 3/1994 | Chow | |
| 5,347,892 | A | 9/1994 | Moetteli | |
| 5,392,672 | A | 2/1995 | Larson et al. | |
| 5,404,773 | A | 4/1995 | Norville | |
| 5,425,291 | A | 6/1995 | Chang | 81/60 |
| 5,448,931 | A | 9/1995 | Fosella et al. | |
| 5,467,672 | A | 11/1995 | Ashby | |
| 5,477,757 | A | 12/1995 | Maresh | |
| 5,495,783 | A | 3/1996 | Slusar et al. | |
| 5,499,560 | A | 3/1996 | Aeschliman | |
| 5,501,124 | A | 3/1996 | Ashby | |
| 5,509,333 | A | 4/1996 | Rion | |
| 5,522,288 | A | 6/1996 | Slusar et al. | |
| 5,533,427 | A | 7/1996 | Chow | 81/63.2 |
| 5,535,646 | A | 7/1996 | Allen et al. | |
| 5,537,899 | A * | 7/1996 | Diedrich | 81/57.39 |
| 5,557,994 | A | 9/1996 | Nakayama | |
| 5,582,081 | A | 12/1996 | Lin | |
| 5,595,095 | A | 1/1997 | Hillinger | |
| 5,622,089 | A | 4/1997 | Gifford, Sr. | |
| 5,626,061 | A | 5/1997 | Whitley | |
| 5,626,062 | A | 5/1997 | Colvin | 81/63.2 |
| 5,636,557 | A | 6/1997 | Ma | |
| 5,709,137 | A | 1/1998 | Blacklock | |
| 5,749,272 | A | 5/1998 | Phan | |
| 5,782,147 | A | 7/1998 | Chaconas et al. | |
| 5,794,496 | A | 8/1998 | Arnold | 81/63.2 |
| 5,829,326 | A | 11/1998 | Richner | |
| 5,842,391 | A | 12/1998 | Chaconas | |
| 5,857,390 | A | 1/1999 | Whiteford | 81/62 |
| 5,873,286 | A | 2/1999 | Van Lenten | |
| 5,878,635 | A | 3/1999 | Hsieh | |
| 5,884,537 | A | 3/1999 | Chen | |
| 5,884,538 | A | 3/1999 | Van Lenten | |
| 5,887,493 | A | 3/1999 | Main | |
| 5,901,620 | A | 5/1999 | Arnold | 81/63 |
| 5,910,197 | A | 6/1999 | Chaconas | |
| 5,911,798 | A | 6/1999 | Arnold | |

| | | | | |
|---|---|---|---|---|
| 5,913,954 | A | 6/1999 | Arnold et al. | |
| 5,927,158 | A | 7/1999 | Lin | |
| 5,946,987 | A | 9/1999 | Wei | |
| 5,946,989 | A | 9/1999 | Hsieh | |
| 5,957,009 | A | 9/1999 | McCann | 81/63.2 |
| 5,964,129 | A | 10/1999 | Shiao | |
| 5,970,552 | A | 10/1999 | Kwiecien et al. | |
| 5,979,274 | A | 11/1999 | Hsieh | |
| 5,996,453 | A | 12/1999 | Blacklock | |
| 6,000,302 | A | 12/1999 | Chiang | |
| 6,006,631 | A | 12/1999 | Miner et al. | |
| 6,044,731 | A | 4/2000 | Hsieh | |
| 6,065,374 | A | 5/2000 | Taggart | 81/63.2 |
| 6,125,722 | A | 10/2000 | Hopper, Jr. et al. | |
| 6,134,990 | A | 10/2000 | Ling et al. | |
| 6,134,991 | A | 10/2000 | Chaconas | |
| D433,896 | S | 11/2000 | Wei | |
| D434,292 | S | 11/2000 | Hsieh | |
| 6,148,695 | A | 11/2000 | Hu | |
| 6,152,826 | A | 11/2000 | Profeta et al. | |
| 6,155,140 | A | 12/2000 | Tsai | |
| 6,161,454 | A * | 12/2000 | Chaconas | 81/63.2 |
| 6,164,167 | A | 12/2000 | Chen | 81/63 |
| 6,205,889 | B1 | 3/2001 | Hsieh | |
| 6,209,422 | B1 * | 4/2001 | Kamiya et al. | 81/57.39 |
| 6,209,423 | B1 | 4/2001 | Shiao | |
| 6,216,563 | B1 | 4/2001 | Hsieh | |
| 6,216,567 | B1 | 4/2001 | Hu | |
| 6,220,123 | B1 | 4/2001 | Chen | |
| 6,230,591 | B1 | 5/2001 | Ling et al. | |
| 6,240,813 | B1 | 6/2001 | Hyatt | |
| 6,257,096 | B1 | 7/2001 | Ling | |
| 6,260,448 | B1 | 7/2001 | Chaconas | |
| 6,263,767 | B1 | 7/2001 | Hu | |
| 6,282,991 | B1 | 9/2001 | Hu | |
| 6,282,992 | B1 | 9/2001 | Hu | |
| 6,282,993 | B1 | 9/2001 | Forman et al. | |
| 6,301,998 | B1 | 10/2001 | Hu | |
| 6,308,594 | B1 | 10/2001 | Cheng | |
| 6,332,382 | B1 | 12/2001 | Anderson et al. | |
| 6,334,373 | B1 | 1/2002 | Hsieh | |
| 6,382,051 | B1 | 5/2002 | Chang | |
| 6,427,560 | B1 | 8/2002 | Shea | |
| 6,431,031 | B1 | 8/2002 | Hu | |
| 6,435,062 | B1 | 8/2002 | McCann | |
| 6,435,063 | B1 | 8/2002 | Chen | |
| 6,450,066 | B1 | 9/2002 | Hu | |
| 6,450,068 | B1 | 9/2002 | Hu | |
| 6,453,779 | B2 | 9/2002 | Hu | |
| 6,457,387 | B1 | 10/2002 | Hu | |
| 6,457,389 | B1 | 10/2002 | Hu | |
| 6,516,691 | B1 | 2/2003 | Wei | |
| 6,520,051 | B1 | 2/2003 | Hu | |
| 6,539,825 | B1 | 4/2003 | Lin | |
| 6,568,299 | B2 | 5/2003 | Hu | |
| 6,591,717 | B2 | 7/2003 | Wei | |
| 6,629,477 | B2 | 10/2003 | Ling et al. | |
| 6,644,148 | B2 | 11/2003 | Hu | |
| 6,647,832 | B2 | 11/2003 | Hu | |
| 6,666,112 | B2 | 12/2003 | Hu | |
| 6,666,117 | B2 | 12/2003 | Hu | |
| 6,688,195 | B1 | 2/2004 | Hsien | |
| 6,708,586 | B1 | 3/2004 | Chen | |
| 6,722,234 | B2 | 4/2004 | Hu | |
| 6,732,614 | B2 | 5/2004 | Hu | |
| 6,748,825 | B2 | 6/2004 | Hsu | |
| 6,758,641 | B2 | 7/2004 | Hu | |
| 6,761,092 | B2 | 7/2004 | Hsien | |
| 2002/0023520 | A1 | 2/2002 | Hu | |
| 2002/0088312 | A1 | 7/2002 | Ling et al. | |
| 2002/0162423 | A1 | 11/2002 | Hu | |
| 2002/0166417 | A1 | 11/2002 | Hu | |
| 2002/0166418 | A1 | 11/2002 | Hsieh | |
| 2002/0194950 | A1 | 12/2002 | Hu | |
| 2003/0070512 | A1 | 4/2003 | Hu | |
| 2003/0121373 | A1 | 7/2003 | Ling et al. | |
| 2003/0154826 | A1 | 8/2003 | Lee | |
| 2003/0196522 | A1 | 10/2003 | Hu | |
| 2004/0093995 | A1 | 5/2004 | Hu | |

FOREIGN PATENT DOCUMENTS

| | | | |
|---|---|---|---|
| DE | 921198 | | 7/1949 |
| DE | 1 810 811 | * | 6/1970 |
| DE | 1810811 | | 6/1970 |
| DE | 2 9907467 | | 9/1999 |
| DE | 2 9910932 | | 9/1999 |
| FR | 498276 | | 1/1920 |
| GB | 1559093 | | 1/1980 |
| GB | 2135226 | | 8/1984 |
| JP | 11165271 A | * | 6/1999 |
| TW | 130638 | | 12/1977 |
| TW | 212343 | | 5/1982 |
| TW | 310649 | | 1/1986 |

OTHER PUBLICATIONS

Appeal Brief against Office Action on Opposition to Patent Application No. 089200570 P01 in Taiwan and translation of same.

First Office Action on Patent Application No. 001003289 in People's Republic of China and Translation.

Office Action by Taiwan Intellectual Property Office on Opposition to Patent Application No. 089200570 in Taiwan and Translation; and Translations of Taiwanese Patent Publication No. 212343, of Taiwanese Patent Publication No. 310649, and of Taiwanese Patent Publication No. 130638, abstracts.

Decision by the Board of Appeal and Translation of same.

Taiwan Intellectual Property Office's Answer to Appeal Brief and Translation of same.

Complaint for Declatory Judgment of Noninfringement, Unenforceability, and Invalidity of a Patent, dated Sep. 26, 2002.

Amended Complaint for Declatory Judgment of Noninfringement, Unenforceability, and Invalidity of a Patent, dated Sep. 19, 2003.

Plaintiff's Second Supplemental Response to Interrogatory No. 3 of Defendant's First Set of Interrogatories, dated Apr. 21, 2004.

* cited by examiner

BIASING ARRANGEMENT FOR A PAWL OF A REVERSIBLE RATCHET-TYPE WRENCH

CROSS REFERENCE

This application is a continuation of Ser. No. 09/541,193 filed Apr. 3, 2000, now U.S. Pat. No. 6,282,992.

BACKGROUND OF THE INVENTION

1. Field of the Invention

The present invention relates to a biasing arrangement for a pawl of a reversible ratchet type wrench to provide reliable ratcheting. The present invention also relates to an improved head structure for a ratchet-type wrench to lower the manufacture cost.

2. Description of the Related Art

U.S. Pat. No. 2,957,377 issued to Hare on Oct. 25, 1960 discloses a reversible ratchet-type wrench comprising a body 10 having a handle 11 and a head 12. A cap 39 and an annular wall 44 are provided to the upper side and the lower side of the head 12, respectively. Yet, this increases the assembly time and the manufacture cost and adversely affects the appearance. A shifting lever 35 is retained in place by a spring 33 that is located in a cylindrical opening 34. Nevertheless, formation of the cylindrical opening 34 that extends upward at an incline is relatively difficult. In addition, formation of the cavity 16 having converging straight sides 17, 18 which diverge in the direction of the periphery of the rotatable member 14 requires expensive and accurate computer-numeric-control (CNC), which further results in an increase in the cost together with a low production rate. This is why such a reversible ratchet-type wrench is hardly seen in the market.

FIGS. 10 and 11 illustrate another conventional ratchet type wrench comprising a handle 12' and a head 11'. The head 11' is machined to form four consecutive compartments for receiving the drive member 20', the pawl 30' and the shifting lever 40', wherein three of the compartments can be formed by cutting, yet the remaining one must be machined by CNC. Further, the resultant head structure is relatively weak and thus has a poor torque-bearing capacity. In addition, the movement of the pawl 30' for changing ratcheting direction is found unreliable, as it is achieved via transmission of the hook end 442' of a spring 44' attached to the shifting lever 40'.

SUMMARY OF THE INVENTION

In accordance with a first aspect of the invention, a reversible ratchet-type wrench comprises:

a handle;

a head extended from the handle and including a hole, a web being defined between the handle and the head, a cavity being defined in the web and communicated with the hole, the web further including a compartment having a first end communicated with the cavity and a second end communicated with outside, thereby leaving a bridge in the web;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member;

a switch member including a turn-piece for manual operation and an actuating plate extended from the turn-piece and rotatably received in the second end of the compartment of the web, the switch member being switchable between two positions for changing ratcheting direction of the drive member; and a biasing means mounted in the cavity and between the pawl and the actuating plate for biasing the ratchet teeth of the pawl to engage with the teeth of the drive member.

An inner periphery defining the hole of the head includes a first annular groove. The outer periphery of the drive member includes a second annular groove. A C-clip is received in the first annular groove and the second annular groove, thereby rotatably retaining the drive member in the head.

The biasing means includes an elastic element and a peg. The pawl further includes a second side with a recess. The peg has a first end movably received in the recess of the pawl and a second end. The elastic element biases the second end of the peg for exerting a force to the peg toward the pawl, thereby urging the ratchet teeth of the pawl to engage with the teeth of the gear wheel.

In an embodiment of the invention, the actuating plate of the switch member includes a receptacle that faces the cavity. The elastic element includes a first end received in the receptacle and a second end outside the receptacle and configured to be attached to the actuating plate. The second end of the peg is received in the elastic element. The first end of the elastic element is configured to bias the second end of the peg toward the recess of the pawl.

In another embodiment of the invention, the actuating plate of the switch member includes a first receptacle that faces the cavity, the first receptacle having a first end wall. The second end of the peg is received in the first receptacle and includes a second receptacle with a second end wall. Two ends of the elastic element are attached between the first end wall and the second end wall.

The drive member may be a gear wheel including an inner periphery for driving a fastener. Alternatively, the drive member includes a drive column for releasably engaging with a socket. The head includes an end wall with an opening, and the drive member includes a stub rotatably received in the opening.

In accordance with a second aspect of the invention, a reversible ratchet-type wrench comprises:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member including a turn-piece for manual operation and an actuating plate extended from the turn-piece and rotatably received in the compartment of the web, the switch member being switchable between two positions for changing ratcheting direction of the drive member; and a biasing means mounted in the cavity and between the recess of the pawl and the actuating plate for biasing the ratchet teeth of the pawl to engage with the teeth of the drive member, the biasing means including an elastic element and a peg, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the actuating plate of the switch member including a receptacle that faces the cavity, the elastic element including a first end received in the receptacle and a second end outside the receptacle and configured to be attached to the actuating plate, the second end of the peg being received in the elastic element, the first end of the elastic element being configured to bias the second end of the peg toward the recess of the pawl.

In accordance with a third aspect of the invention, a reversible ratchet-type wrench comprises:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member including a turn-piece for manual operation and an actuating plate extended from the turn-piece and rotatably received in the compartment of the web, the switch member being switchable between two positions for changing ratcheting direction of the drive member; and a biasing means mounted in the cavity and between the recess of the pawl and the actuating plate for biasing the ratchet teeth of the pawl to engage with the teeth of the drive member, the biasing means including an elastic element and a peg, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the actuating plate of the switch member including a first receptacle that faces the cavity, the first receptacle having a first end wall, the second end of the peg being received in the first receptacle and including a second receptacle with a second end wall, the elastic element having two ends that are attached between the first end wall and the second end wall.

In accordance with a fourth aspect of the invention, a reversible ratchet-type wrench comprises:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member rotatably received in the compartment of the web, the switch member being switchable between two positions for changing ratcheting direction of the drive member; and a biasing means mounted in the cavity and having a first end slidably received in the recess of the pawl and a second end attached to the switch member for biasing the ratchet teeth of the pawl to engage with the teeth of the drive member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
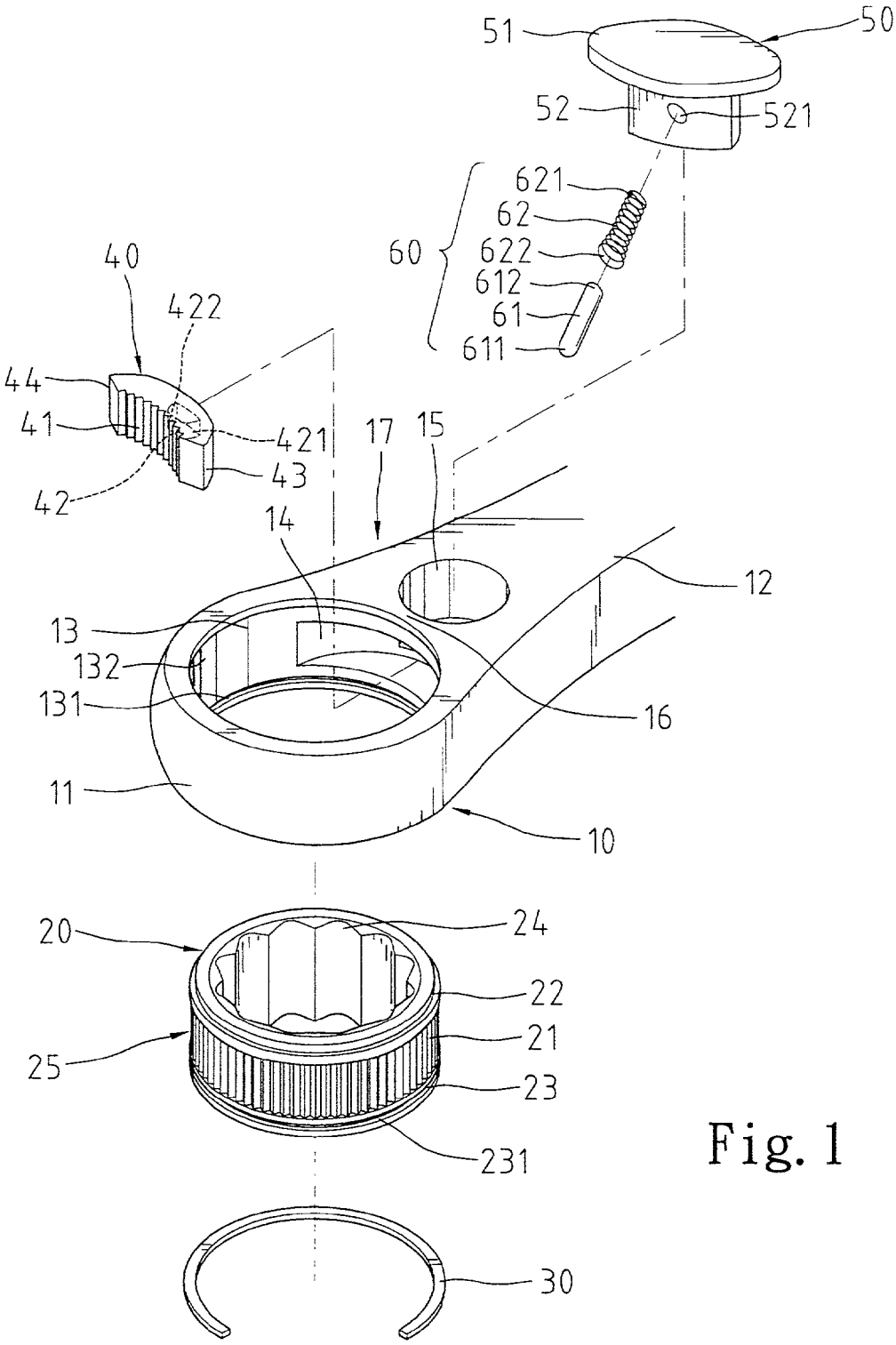
FIG. 1 is an exploded perspective view of an end portion of a first embodiment of a ratchet-type wrench in accordance with the present invention.

Referring to FIGS. 1 through 9 and initially to FIGS. 1, 2, 3, and 6, a ratchet-type wrench 10 in accordance with the present invention generally includes a handle 12 and a head 11 having a hole 13. An inner periphery 132 defining the hole 13 of the head 11 includes an annular groove 131 in a lower portion thereof. A web 17 is defined between the head 11 and the handle 12. A cavity 14 is defined in the web 17. Also defined in the web 17 is a compartment 15 that is substantially L-shape and includes an inner end communicated with the cavity 14 and an outer end communicated with outside, thereby leaving a bridge 16 on the web 17. The outer end of the compartment 15 is preferably circular. The bridge 16 increases the strength of the head 11 and the handle 12, thereby providing a higher torque-bearing capacity.

A drive member (in the form of a gear wheel 20 in this embodiment) is mounted in the head 11 and includes an inner periphery 24 for driving a fastener (not shown) and an outer periphery 25. The outer periphery 25 includes a recessed upper end portion 22, a lower end portion 23, and a middle portion with a plurality of recessed teeth 21. The lower end portion 23 includes an annular groove 231. A C-clip 30 is received in the annular groove 231 of the lower end portion 23 and the annular groove 131 of the head 11, thereby rotatably retaining the gear wheel 20 in the head 11 of the wrench 10, best shown in FIG. 2.

A pawl 40 is mounted in cavity 14 in the web 17 and includes ratchet teeth 41 on a side thereof for engaging with teeth 21 of the gear wheel 20. The other side of the pawl 40 further includes a recess 42 having two ends 421 and 422, which will be described later.

Figure 2:
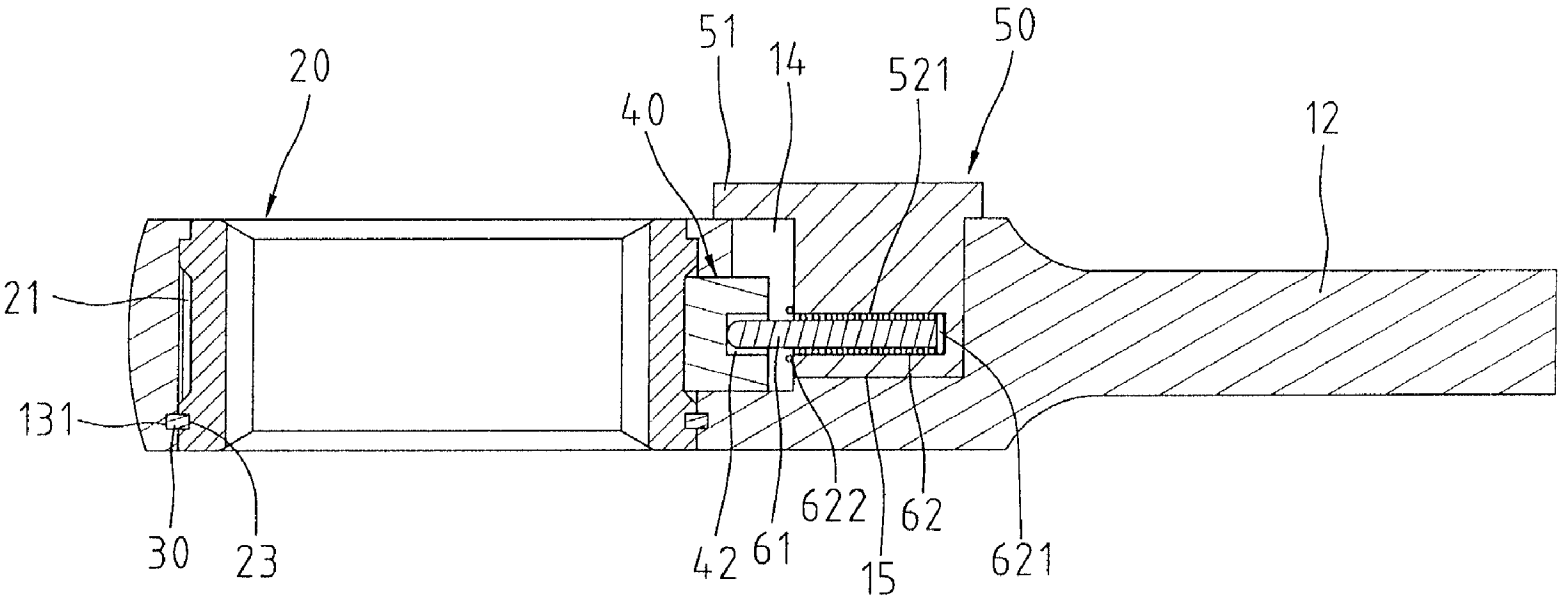
FIG. 2 is a sectional view of the end portion of the first embodiment of the ratchet-type wrench in accordance with the present invention.
Figure 3:
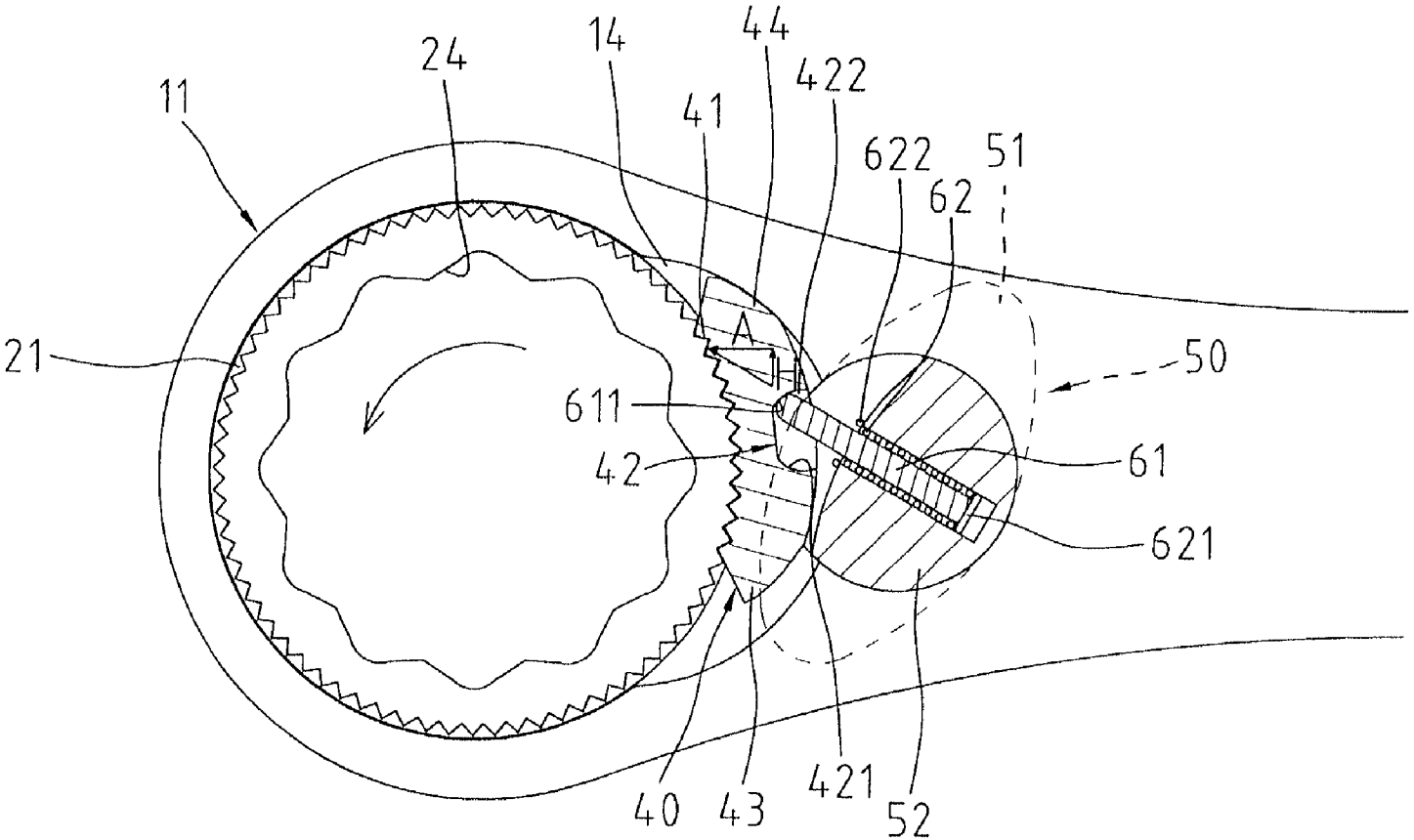
FIG. 3 is a top view, partly sectioned, of the end portion of the first embodiment of the ratchet-type wrench in accordance with the present invention, wherein the wrench is in a status allowing counterclockwise ratcheting.

Still referring to FIGS. 1 through 3, a switch member 50 is rotatably mounted to the second end of the compartment 15. In this embodiment, the switch member 50 includes a turn-piece 51 outside the compartment 15 for manual operation and an actuating plate 52 extended from the turn-piece 51 and having a receptacle 521 that faces the cavity 14. A biasing means 60 is mounted in the receptacle 521 and includes an elastic element 62 and a peg 61. In this embodiment, as illustrated in FIG. 2, the elastic element 62 includes a first end 621 configured to bias an end 612 of the peg 61. A second end 622 of the elastic element 62 is configured to have a larger diameter so as to bear against and thus be attached to the actuating plate 52 in an area surrounding an opening section (not labeled) of the receptacle 521, as shown in FIG. 3.

In assembly, the switch member 50 is mounted in the compartment 15 and the biasing means 60 is mounted into the receptacle 521 of the switch member 50 via the cavity 14 with the elastic element 62 surrounding a part of the peg 61. The end 612 of the peg 61 bears against the first end 621 of the elastic element 62. The pawl 40 is mounted into the cavity 14 with the other end 611 of the peg 61 extended into the recess 42 of the pawl 40. The C-clip 30 is placed into the hole 13 and the gear wheel 20 is then mounted in the hole 13 with the C-clip 30 received in the annular grooves 131 and 231, thereby completing the assembly. Thus, the assembly procedure is simple and can be accomplished quickly by a C-clip 30 without the aid of any screw or cover.

Figure 4:
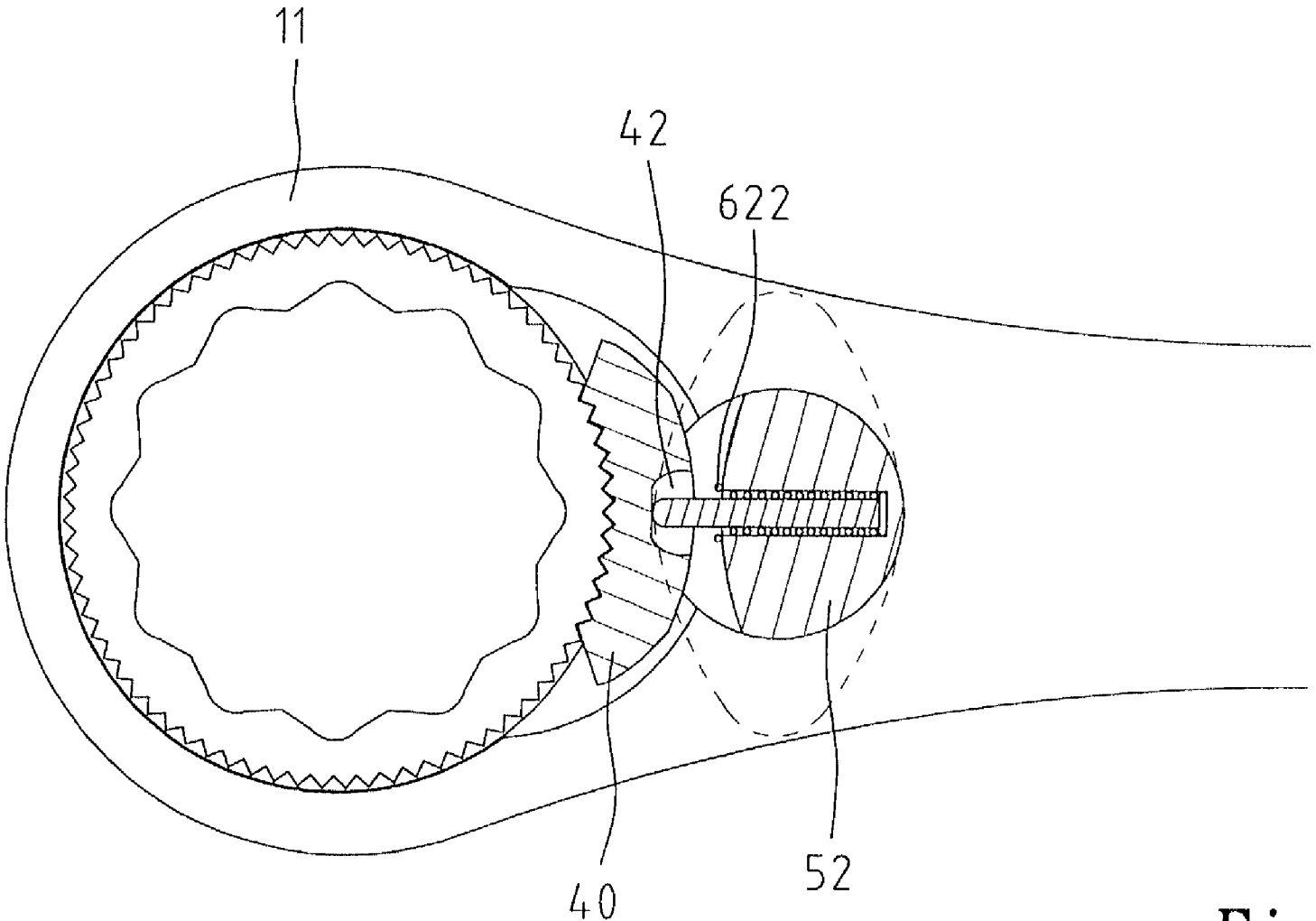
FIG. 4 is a view similar to FIG. 3, wherein the wrench is in a status allowing free rotation in both directions.
Figure 5:
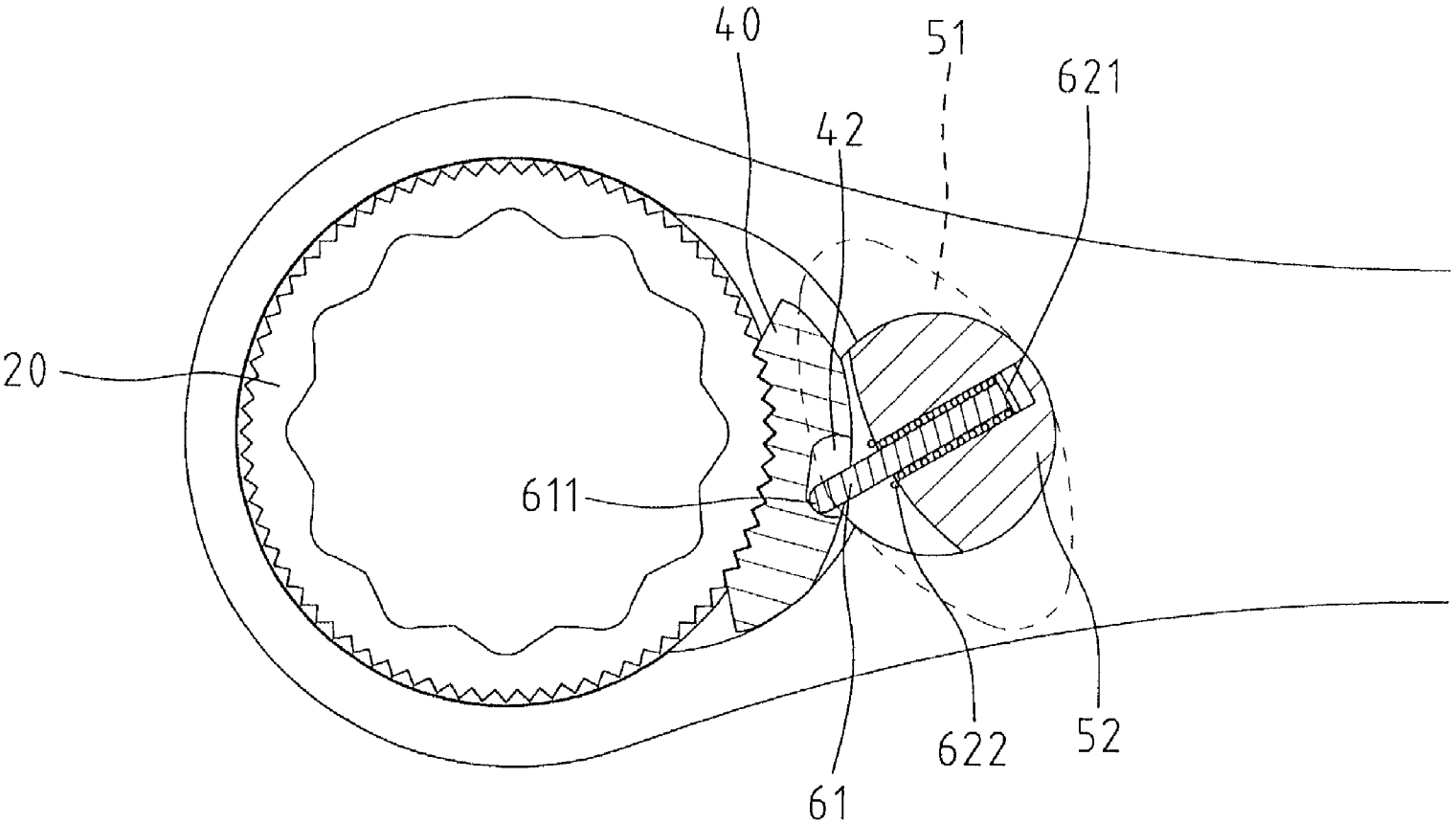
FIG. 5 is a view similar to FIG. 3, wherein the wrench is in a status allowing clockwise ratcheting.
Figure 6:
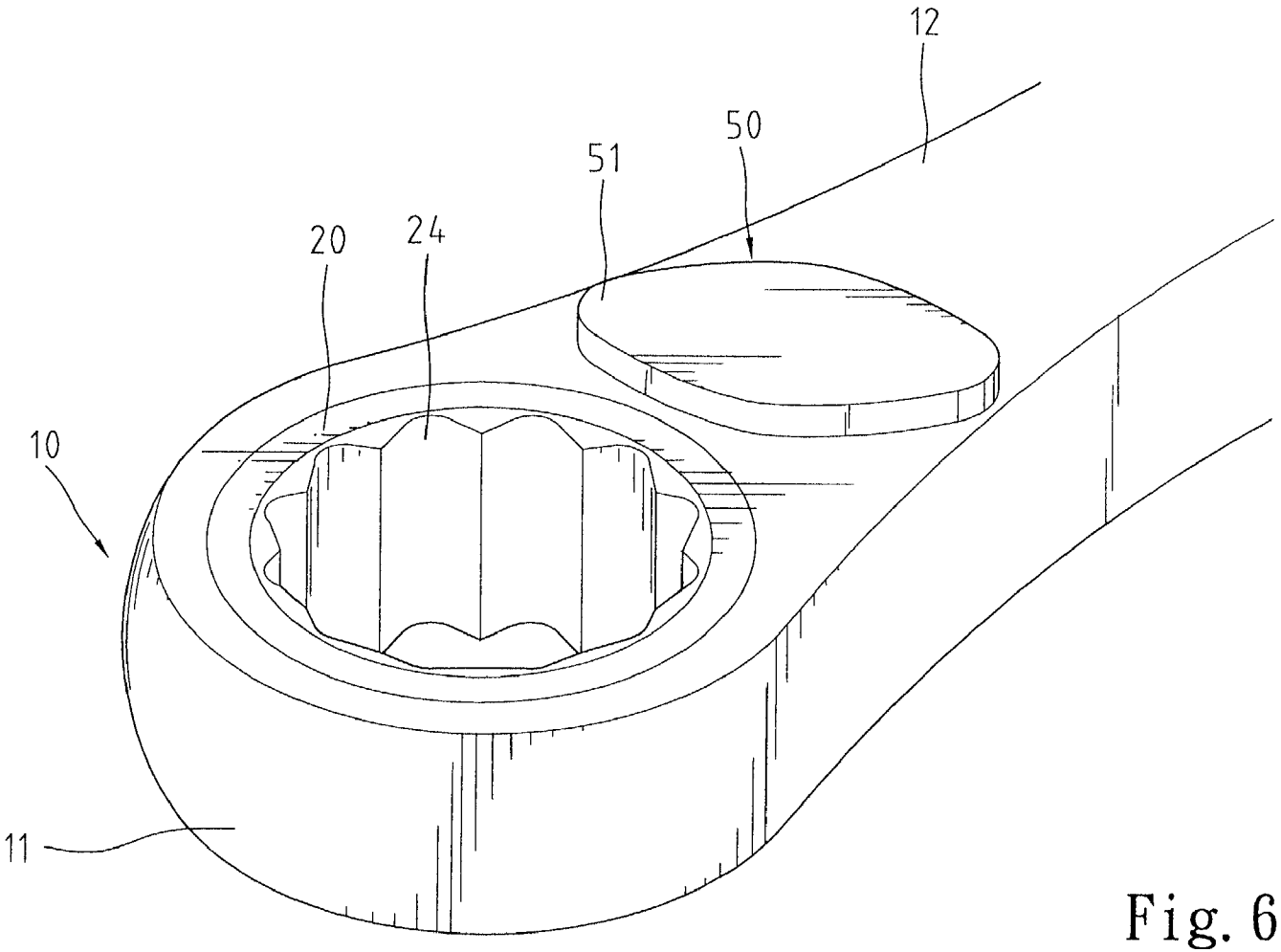
FIG. 6 is a perspective view of the end portion of the first embodiment of the ratchet-type wrench in accordance with the present invention.

The ratchet-type wrench in FIG. 3 is in a status allowing counterclockwise ratcheting (free rotation in clockwise direction), in which the other end 611 of the peg 61 bears against an end 422 of the recess 42 of the pawl 40, and an end 44 of the pawl 40 bears against a wall portion defining the cavity 14. When a change in the ratcheting direction is required, the user may switch the turn-piece 51 and thus cause the biasing means 60 to move. FIG. 4 shows a transition position for the ratchet-type wrench that allows free rotation in both directions. As illustrated in FIG. 4, the elastic element 62 is stretched during rotational movement of the turn-piece. When the turn-piece 51 reaches its predetermined position shown in FIG. 5, the other end 611 of the peg 61 bears against the other end 421 of the recess 42 of the pawl 40, and the other end 43 of the pawl 40 bears against another wall portion defining the cavity 14. Thus, the ratchet-type wrench is in a status allowing clockwise ratcheting and free rotation in the counterclockwise direction.

Figure 7:
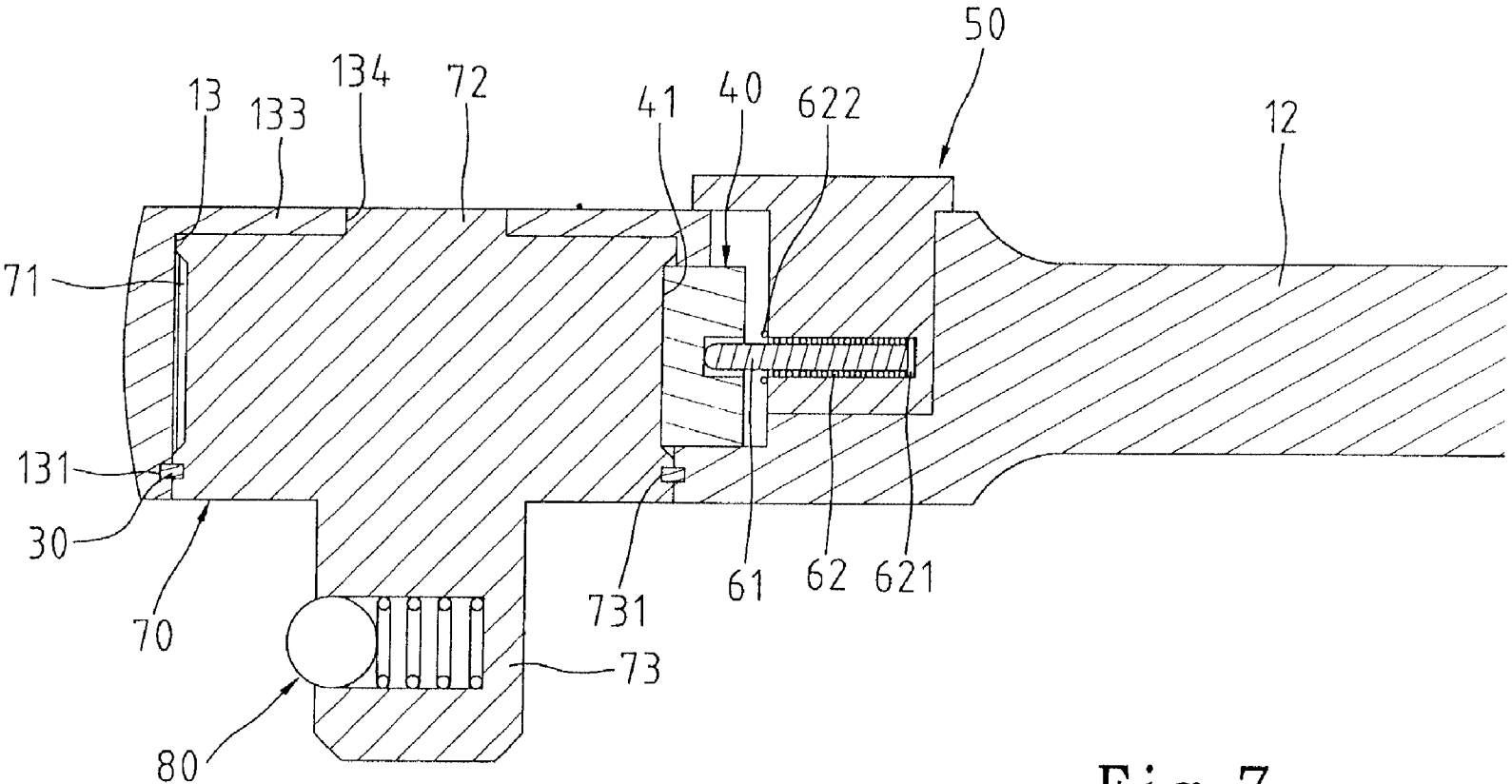
FIG. 7 is a sectional view illustrating a second embodiment of the ratchet-type wrench in accordance with the present invention.

FIG. 7 illustrates a second embodiment in accordance with the present invention, wherein the gear wheel 20 is replaced by a drive member 70 having a drive column 73 with an engaging means 80 for releasably engaging with a socket (not shown). The drive member 70 includes an outer periphery having a plurality of teeth 71 for engaging with the ratchet teeth 41. An annular groove 731 is defined in a lower portion of the outer periphery of the drive member 70 for engaging with the C-clip 30, which is identical to that disclosed above. In addition, the drive member 70 includes a stub 72 on a top thereof, and the upper portion of the head 11 is modified to include an end wall 133 with an opening 134 for rotatably receiving the stub 72 of the drive member 70, thereby providing stable rotational movement for the drive member 70.

Figure 8:
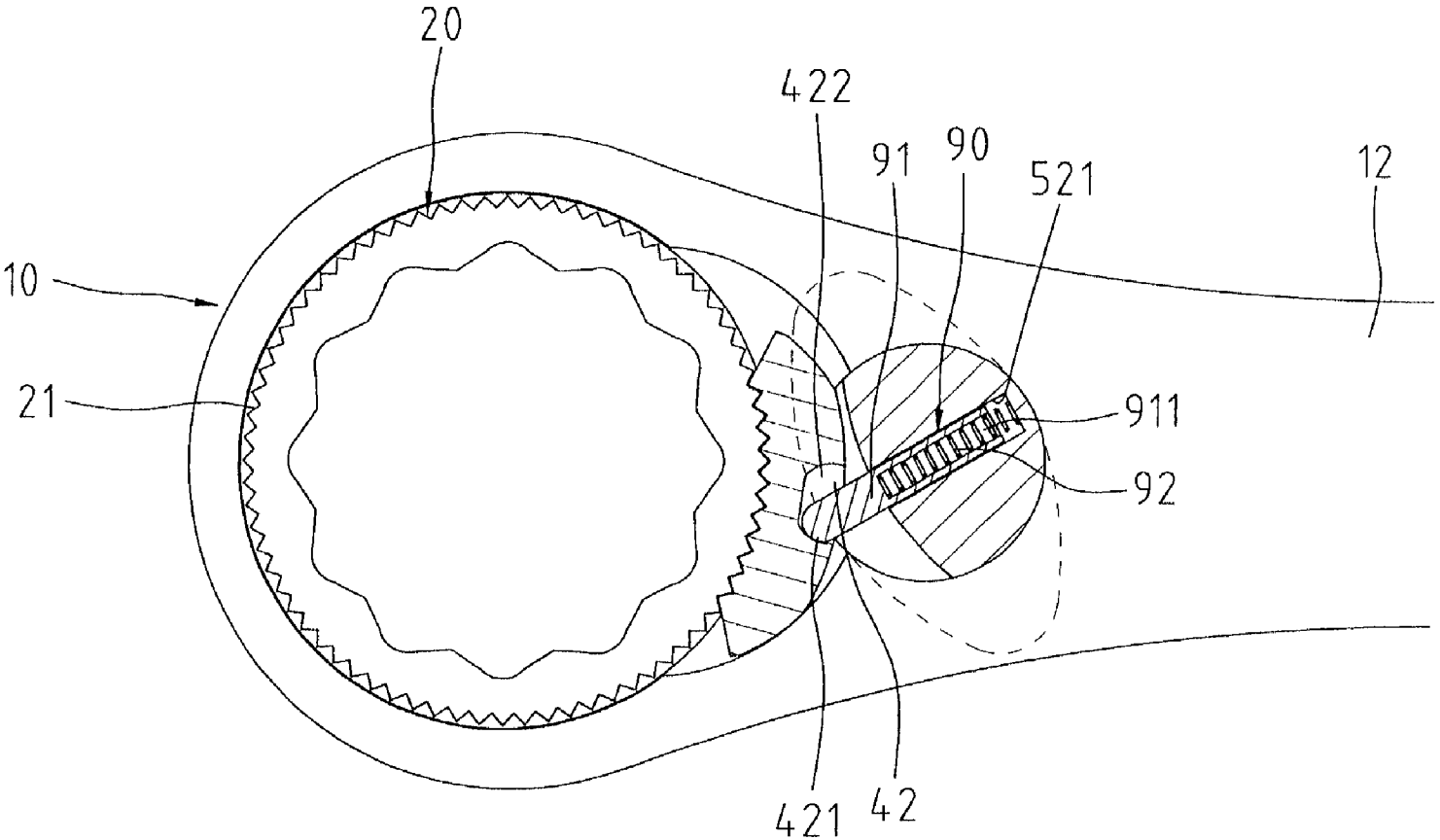
FIG. 8 is a top view of an end portion of a third embodiment of the ratchet-type wrench in accordance with the present invention.

FIG. 8 illustrates a third embodiment in accordance with the present invention. It is noted that the biasing means (now designated by 90) in this embodiment includes a pin 91 having a receptacle 911 for receiving an end of the elastic element 92. Thus, the elastic element 92 is attached between an end wall (not labeled) defining the receptacle 911 of the pin 91 and an end wall (not labeled) defining the receptacle 521 of the switch member 50.

Figure 9:
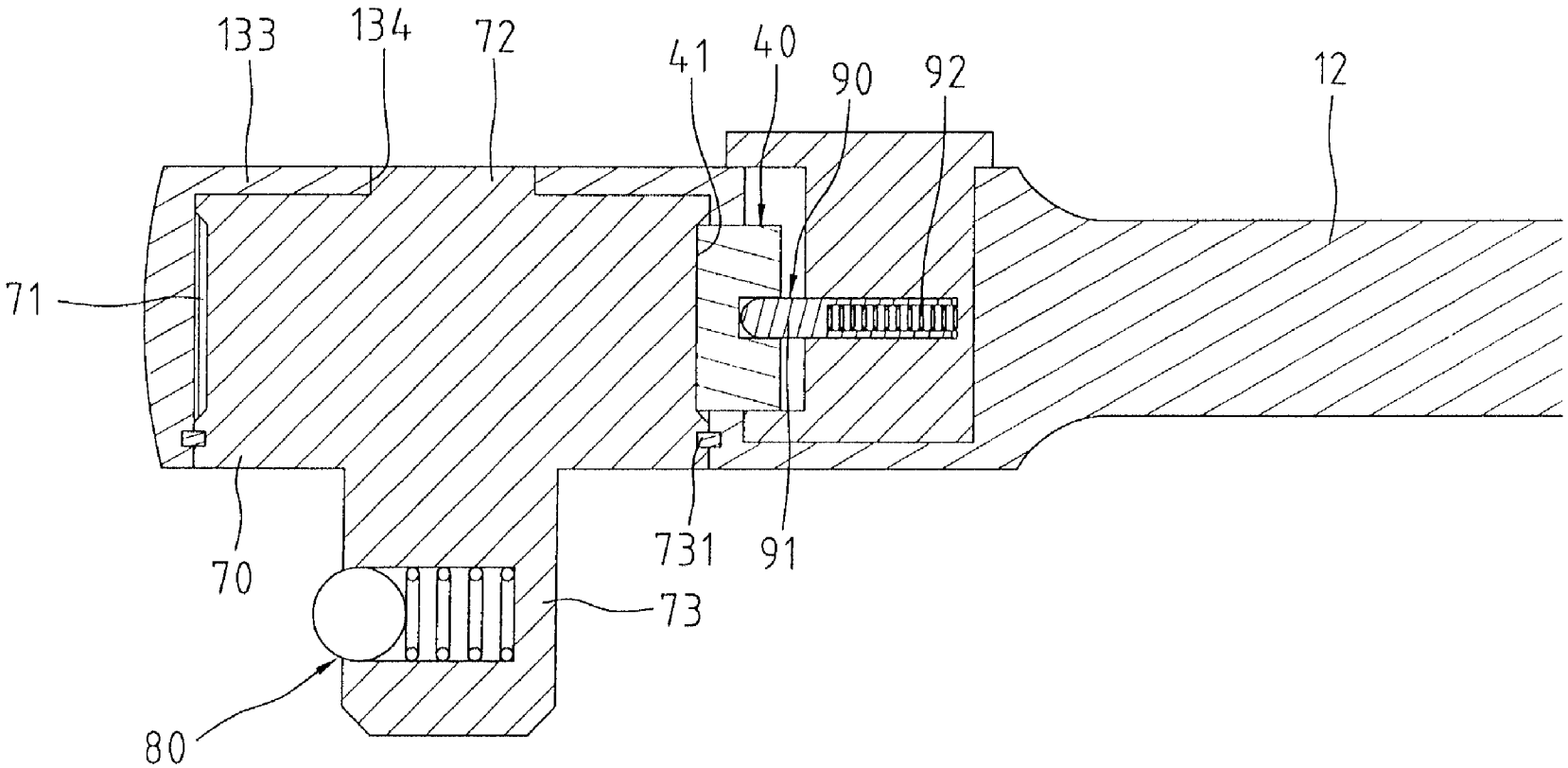
FIG. 9 is a sectional view illustrating a fourth embodiment of the ratchet-type wrench in accordance with the present invention.
Figure 10:
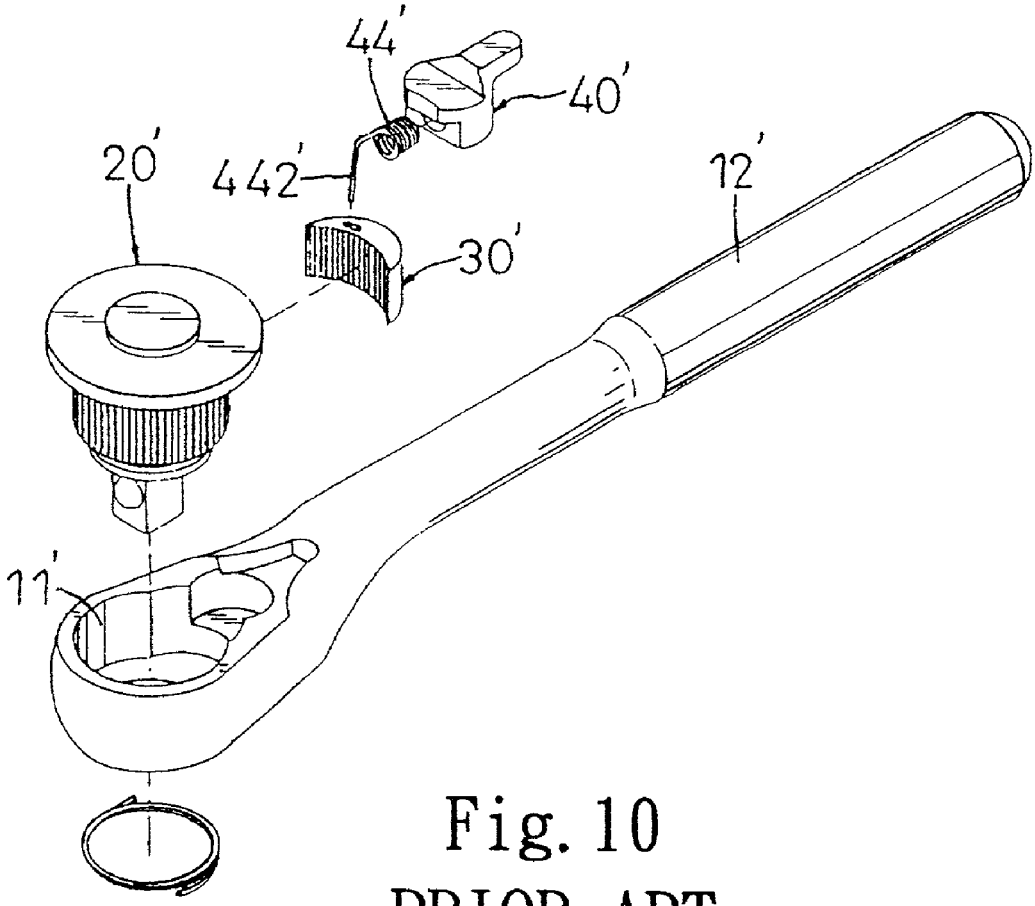
Fig. 10 PRIOR ART
FIG. 10 is an exploded perspective view of a conventional ratchet type wrench.
Figure 11:
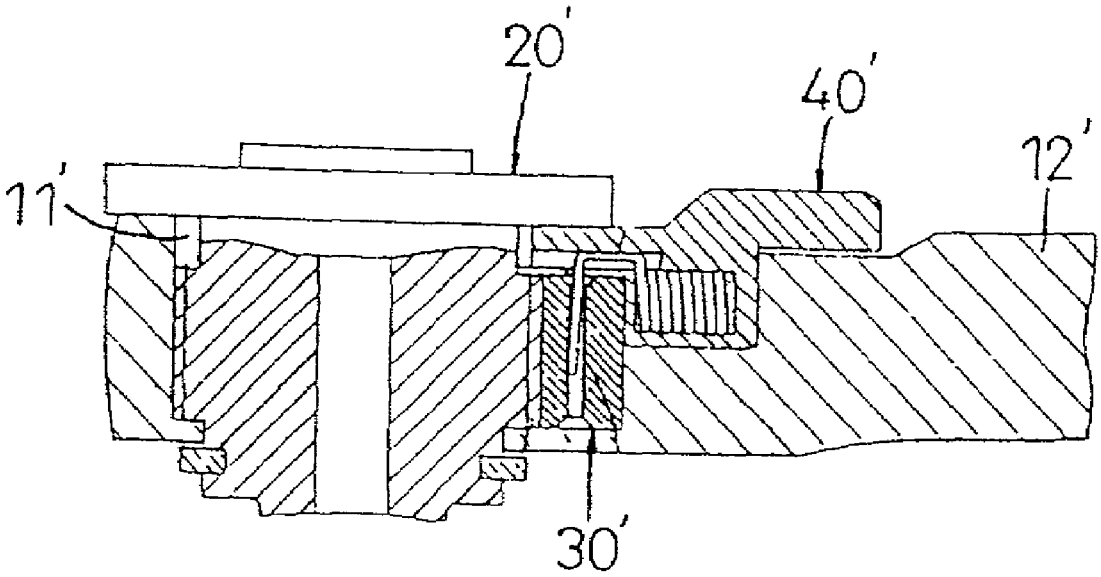
Fig. 11 PRIOR ART
FIG. 11 is a sectional view of a head portion of the conventional ratchet type wrench in FIG. 10.

FIG. 9 illustrates a fourth embodiment in accordance with the present invention. It is noted that the biasing means 90 in the fourth embodiment is identical to that of the third embodiment, and the drive member 70 in the fourth embodiment is identical to that of the second embodiment.

Although the invention has been explained in relation to its preferred embodiment, it is to be understood that many other possible modifications and variations can be made without departing from the spirit and scope of the invention as hereinafter claimed.

What is claimed is:

1. A reversible ratchet-type wrench comprising:

a handle;

a head extended from the handle;

a cavity disposed in a web defined between the handle and the head;

a compartment disposed in the web and having a first end communicated with the cavity and a second end communicated with outside, thereby leaving a bridge in the web;

a drive member rotatably mounted in a hole through the head, with the drive member including a plurality of teeth formed on an outer periphery thereof;

a pawl disposed within the cavity and including a first side with a plurality of ratchet teeth for releasably engaging with the teeth of the drive member, with the pawl further including a second side with a recess;

a rotatable switch member disposed within the compartment and including a turn-piece for manual operation and an actuating plate extended from the turn-piece, the switch member being switchable between two positions for changing ratcheting direction of the drive member, with the actuating plate of the switch member including a first receptacle that faces the recess of the pawl and that has a first end wall;

an elastic element having a first end disposed with the first receptacle and a second end attached to the rotatable switch member; and a peg, with the peg having a first end movably received in the recess of the pawl and a second end, with the second end of the peg being received in the first receptacle, with the first end of the elastic element configured to bias the second end of the peg, with the peg and the elastic member being rotatable with the actuating plate and biasing the ratchet teeth of the pawl to engage with the teeth of the drive member.

2. The reversible ratchet-type wrench as claimed in claim 1, wherein the drive member is a gear wheel including an inner periphery adapted to drive a fastener.

3. The reversible ratchet-type wrench as claimed in claim 1, wherein the drive member includes a drive column for releasably engaging with a socket.

4. The reversible ratchet-type wrench as claimed in claim 3, wherein the head includes an end wall with an opening, and wherein the drive member includes a stub rotatably received in the opening.

5. The reversible ratchet-type wrench as claimed in claim 1, with the drive member being rotatably mounted in a hole of the head, wherein an inner periphery defining the hole of the head includes a first annular groove, and wherein the outer periphery of the drive member includes a second annular groove, with the reversible ratchet-type wrench further comprising a C-clip received in the first annular groove and the second annular groove, thereby rotatably retaining the drive member in the head.

6. The reversible ratchet-type wrench as claimed in claim 5, wherein the drive member includes a top and a bottom, with the outer periphery extending between the top and the bottom, with the second annular groove being spaced from the top and the bottom.

7. The reversible ratchet-type wrench as claimed in claim 1, with the switch member being rotatable about an axis, with the actuating plate extending in a direction parallel to the axis of the switch member from the turn-piece.

8. The reversible ratchet-type wrench as claimed in claim 1, with the peg having a periphery extending from the second end, with the periphery of the peg being of a size for slideable receipt within the first receptacle.

9. The reversible ratchet-type wrench as claimed in claim 1, further comprising, in combination: a web being defined between the handle and the head; and a cavity defined in the web, with the pawl having a first end and an opposite end, with the first end of the pawl engaging a wall portion defining the cavity in one of the two positions of the switch member and the opposite end of the pawl engaging another wall portion defining the cavity in the other of the two positions of the switch member.

10. A reversible ratchet-type wrench comprising:

a handle;

a head extended from the handle, the head defining a hole through the head, the hole having a periphery;

a web defined between the handle and the head, the web defining a cavity and a compartment, the cavity having a first cavity wall portion and an opposite second cavity wall portion and being in communication with the hole along a peripheral section of the periphery of the hole, the compartment having a first end in communication with the cavity and a second end in communication with an outside of the web;

a drive member rotatably mounted in the hole, the drive member including a plurality of teeth formed on an outer periphery thereof;

a sliding pawl disposed within the cavity, the sliding pawl including a first side having a plurality of ratchet teeth, the ratchet teeth being releasably engaged with the teeth of the drive member, the pawl further including a second side opposite to the fist side, the second side defining a first pawl end portion and an opposite second pawl end portion, the second side of the pawl including a recess defined by a recess wall, the recess wall including a first end shoulder at an end of the recess and a second end shoulder at an opposite end of the recess, the pawl being slideable along the peripheral section of the periphery of the hole between a first pawl location, in which one of the first and second pawl end portion bears on one of the first and second cavity wall portions, and a second pawl location, in which the other of the first and second pawl end portions bears on the other of the first and second cavity wall portions;

a manually rotatable switch member disposed within the compartment and rotatable between a first switching position and a second switching position so as to change a ratcheting direction of the drive member by sliding said pawl between the first pawl location and the second pawl location, the switch member including a first receptacle that faces the recess of the pawl and that has a first end wall;

an elastic element; and a pin having a longitudinal direction and having a first end and a second end, the first end of the pin being movably received in the recess of the pawl and slidably bearing on said recess wall, the second end of the pin being slidably received within the first receptacle and including a second receptacle with a second end wall, the elastic element being located in the first and second receptacles between the first end wall and the second end wall thereby biasing the pin, the pin being rotatable with the switch member and biasing the ratchet teeth of the pawl to engage with the teeth of the drive member;

wherein the first end of the pin is alternately engaged with the first end shoulder and the second end shoulder as the switch member rotates from one of the first and second switching positions to the other of the first and second switching positions, thereby alternately shifting the pawl from one of the first and second pawl locations to the other of the first and second pawl locations along said peripheral section of the hole, and positions of the end shoulders are concurrently shifted with shifting the pawl, and when said one of the first and second end shoulders is engaged by the first end of the pin in said one of the first and second switching positions and in said one of the first and second pawl locations, said one of the first and second end shoulders takes a position in which the first end of the pin is bearing thereon substantially in the longitudinal direction of the pin, thereby bearing an associated one of the first and second pawl end portions against an associated one of the first and second cavity wall portions, while the other of the first and second end shoulders takes an intermediate position between the first and second cavity wall portions, in which the first end of the pin, as the switch member is rotated to the other of the first and second switching positions, becomes engaged with the other of the first and second end shoulders in a side direction of the pin when the first end of the pin is in a mid location between the first and second cavity wall portions, so as to shift the pawl into the other of the first and second pawl locations as the pin continues to rotate from the mid location into the other of the first and second switching positions.

11. The reversible ratchet-type wrench as claimed in claim 10, wherein the drive member is a gear wheel including an inner periphery adapted to drive a fastener.

12. The reversible ratchet-type wrench as claimed in claim 10, wherein the drive member includes a drive column for releasably engaging with a socket.

13. The reversible ratchet-type wrench as claimed in claim 12, wherein the head includes an end wall with an opening, and wherein the drive member includes a stub rotatably received in the opening.

14. The reversible ratchet-type wrench as claimed in claim 10, with the drive member being rotatably mounted in a hole of the head, wherein an inner periphery defining the hole of the head includes a first annular groove, and wherein the outer periphery of the drive member includes a second annular groove, with the reversible ratchet-type wrench further comprising a C-clip received in the first annular groove and the second annular groove, thereby rotatably retaining the drive member in the head.

15. The reversible ratchet-type wrench as claimed in claim 14, wherein the drive member includes a top and a bottom, with the outer periphery extending between the top and the bottom, with the second annular groove being spaced from the top and the bottom.

16. The reversible ratchet-type wrench as claimed in claim 10, with the switch member being rotatable about an axis, with the actuating plate extending in a direction parallel to the axis of the switch member from the turn-piece.

17. The reversible ratchet-type wrench as claimed in claim 10, with the pin having a periphery extending from the second end, with the periphery of the pin being of a size for slideable receipt within the first receptacle, with the second receptacle located within the periphery of the pin.

18. The reversible ratchet-type wrench as claimed in claim 17, with the second receptacle being spaced from the periphery of the pin.

19. The reversible ratchet-type wrench as claimed in claim 10 wherein when the first end of the pawl is engaged with the wall portion of the cavity, the opposite end of the pawl is not engaged with the another wall portion of the cavity.

20. The reversible ratchet-type wrench as claimed in claim 10 wherein the recess wall includes a bottom wall portion intermediate the first end shoulder and the second end shoulder, and wherein the bottom wall portion has a length between the first end shoulder and the second end shoulder, the length being substantially larger than a thickness of the first end of the pin, whereby the first end of the pin is slideable between the end shoulders along the bottom wall portion without sliding the pawl.

21. The reversible ratchet-type wrench as claimed in claim 10 wherein when the drive member is engaged with a fastener, and when the switch member is moved from one of the positions to the other position for moving the pawl from one of the first and second locations to the other of the first and second locations, the first end of the pin moves from one of the first and second wall portions to the other of the first and second wall portions of the pawl, with the first end of the pin pressing against the other of the first and second wall portions of the pawl when a longitudinal axis of the pin is parallel with a longitudinal axis of the handle, thereby imparting a force to the other of the first and second wall portions of the pawl for moving the pawl from one of the first and second locations to the other of the first and second locations, and with the first end of the pin pressing against the intermediate wall portion of the pawl during movement from one of the first and second wall portions to the other of the first and second wall portions of the pawl.

* * * * *